US010264864B2

(12) United States Patent
Bevis

(10) Patent No.: US 10,264,864 B2
(45) Date of Patent: Apr. 23, 2019

(54) CAMERA CARRYING CASE

(71) Applicants: Matthew Bevis, Vancouver (CA); Thom Kennedy, Langley (CA)

(72) Inventor: Matthew Bevis, Vancouver (CA)

(73) Assignee: Bevis Gear Inc., Vancouver (CA)

( * ) Notice: Subject to any disclaimer, the term of this patent is extended or adjusted under 35 U.S.C. 154(b) by 0 days.

(21) Appl. No.: 15/426,967

(22) Filed: Feb. 7, 2017

(65) Prior Publication Data

US 2018/0220762 A1 Aug. 9, 2018

(51) Int. Cl.

| | |
|---|---|
| ***A45C 11/00*** | (2006.01) |
| ***A45C 11/38*** | (2006.01) |
| ***A45F 3/02*** | (2006.01) |
| ***A45C 5/06*** | (2006.01) |
| ***A45C 13/02*** | (2006.01) |

(52) U.S. Cl.

CPC ..... *A45C 11/38* (2013.01); *A45C 5/065* (2013.01); *A45C 13/02* (2013.01); *A45F 3/02* (2013.01); *A45C 2013/026* (2013.01)

(58) Field of Classification Search

CPC ..... A47B 88/06; A47B 47/00; A45C 11/38; A45C 5/065; A45C 2013/026; A45F 3/02

USPC ..... 224/581, 908; 312/302, 322, 323; 190/29, 31, 32, 110

See application file for complete search history.

(56) References Cited

U.S. PATENT DOCUMENTS 289,549 A * 12/1883 Michelson ..... A45C 5/00 190/29
898,549 A * 9/1908 Bonsall ..... A45C 5/00 190/13 R
1,164,833 A * 12/1915 Macaulay ..... A45C 3/06 150/107
1,193,809 A * 8/1916 Mauk ..... A47B 81/00 190/108
1,482,172 A * 1/1924 Weis ..... A47B 88/48 312/323
1,513,176 A * 10/1924 Henry ..... A45C 11/38 206/316.2
1,600,830 A * 9/1926 Lewis ..... A45C 5/005 144/285
2,290,307 A * 7/1942 Wicker ..... A45C 11/38 206/316.2
2,316,716 A * 4/1943 Ries ..... A45C 13/02 190/109
2,804,902 A * 9/1957 Luther ..... A45C 11/38 206/316.2
3,291,179 A * 12/1966 Lang ..... A45C 11/38 206/316.2
3,347,346 A * 10/1967 Young ..... A45C 3/02 190/1
3,363,814 A * 1/1968 Hall, Jr. ..... A45C 13/30 224/199

(Continued)

*Primary Examiner* — Peter N Helvey
(74) *Attorney, Agent, or Firm* — Cameron IP

(57) ABSTRACT

A carrying case comprises a housing having a bottom and a plurality of walls extending from the bottom thereof. A drawer is received by the housing when the carrying case is in a closed configuration. To move the carrying case from the closed configuration to an open configuration, the drawer is removed from the housing and rotated substantially ninety degrees relative to the housing such that the drawer extends substantially perpendicular to the housing when the carrying case is in the open configuration.

10 Claims, 11 Drawing Sheets

(56) References Cited

U.S. PATENT DOCUMENTS 3,627,398 A * 12/1971 Reese ..... G11B 23/0236 206/387.12
3,869,034 A * 3/1975 Thornton, Jr. ..... A45C 5/03 190/111
3,977,013 A * 8/1976 Svatek ..... A45C 11/38 206/316.2
4,008,790 A * 2/1977 Eiteljorg, II ..... A45C 7/005 190/103
4,098,312 A * 7/1978 McCain ..... A45C 11/00 150/106
4,195,727 A * 4/1980 Mele ..... A45C 9/00 190/32
4,323,180 A * 4/1982 Sloop ..... A45F 3/02 206/316.1
4,561,576 A * 12/1985 Lowe ..... A45C 11/38 224/579
4,610,286 A * 9/1986 Cyr ..... A45C 13/02 190/110
4,733,806 A * 3/1988 Sloop ..... A45F 3/02 206/316.2
4,998,603 A * 3/1991 Nordstrom ..... A45C 3/004 190/108
5,050,740 A * 9/1991 Lucero ..... A45C 13/02 190/109
5,205,448 A * 4/1993 Kester ..... A45C 11/38 206/316.2
5,240,106 A * 8/1993 Plath ..... A45C 5/14 190/102
5,242,056 A * 9/1993 Zia ..... G06F 1/1628 190/110
5,255,766 A * 10/1993 Deconinck ..... A45C 13/03 190/110
5,306,077 A * 4/1994 Trevaskis ..... A47B 88/483 312/122
5,400,903 A * 3/1995 Cooley ..... A45C 13/02 190/29
5,676,223 A * 10/1997 Cunningham ..... A45C 3/004 190/109
5,762,250 A * 6/1998 Carlton ..... A45C 9/00 108/43
5,813,354 A * 9/1998 Scott ..... B60N 3/004 108/44
6,070,702 A * 6/2000 Der Kinderen ..... A45C 3/00 190/109
6,076,641 A * 6/2000 Kinzer ..... A45C 5/14 16/18 CG
6,454,064 B1 * 9/2002 Cheng ..... A45C 9/00 190/11
8,240,464 B2 * 8/2012 Clishem ..... A45C 3/004 190/13 H
8,807,406 B1 * 8/2014 Thach ..... A45F 5/00 224/153
2002/0171333 A1 * 11/2002 Stuart ..... A45C 11/00 312/204
2005/0145458 A1 * 7/2005 Cohen ..... A45C 5/065 190/18 A
2007/0140684 A1 * 6/2007 Tsang ..... A45C 11/38 396/419
2010/0171401 A1 * 7/2010 Larson ..... A47B 3/0912 312/249.11

* cited by examiner

CAMERA CARRYING CASE

BACKGROUND OF THE INVENTION

Field of the Invention

The present invention relates to a carrying case and, in particular, to a camera carrying case with improved ease of access when being carried.

Description of the Related Art

U.S. Pat. No. 3,363,814 issued to Hall et al. on Jan. 16, 1968, and the full disclosure of which is incorporated herein by reference, discloses a device for suspending a carrying case from a shoulder. The carrying case has a bottom wall, side walls and a lid hinged to one of the side walls. The suspending device comprises a generally U-shaped handle including spaced arms. There are pivot means for pivotally connecting the spaced arms to opposite side walls of the case. The pivot means define a pivot axis of the carrying case. There is a strap means connected to the handle and adapted to suspend the case from the shoulder of the person. There is a stop means for limiting the pivotal movement of the case about the pivot axis between a first position and a second position. In the first position the carrying case is generally vertical and in a normal carrying position. In the second position the carrying case is generally horizontal and access to an interior of the carrying case is available by lifting the lid.

U.S. Pat. No. 4,323,180 issued to Lowe on Apr. 6, 1982, and the full disclosure of which is incorporated herein by reference, discloses a carrying case that can be suspended from a shoulder of a person and be opened while suspended from the shoulder of the person. The carrying case has a lower case part having opposite side walls and a front, rear, bottom, and open top. A cover is pivotally mounted to the rear of the lower case part. The cover opens and closes over the top of the lower case part. There is a shoulder strap with opposite ends mounted to opposite side walls of the lower case part. There is a fastener means, operable after the cover has been opened, for fastening together locations on the strap and the cover to prevent movement of the strap relative to the cover in a direction which would close the cover. The stiffness of the strap against compression along its length when the strap is under tension, while suspending the carrying case from the shoulder of the person, can be utilized to prevent the cover from closing.

U.S. Pat. No. 4,733,806 issued to Lowe on Mar. 29, 1988, and the full disclosure of which is incorporated herein by reference, also discloses a carrying case that can be carried on a shoulder of a person and be opened while still on the shoulder of the person. The carrying case has a case part forming a rigid bottom wall having a multiplicity of holes. There is a plurality of pylon devices, each having a fastener insertable through a hole in said rigid bottom wall and fastenable in place thereat. The holes are closer together than the width of each pylon device so that two of the pylon devices cannot be mounted in a pair of adjacent holes This enables the mounting of pylons close to the ideal positions for pressing with moderate forces against an instrument to hold it. Each of the pylon devices may have a single threaded stud depending therefrom so the pylon device may be quickly installed by turning the pylon device.

SUMMARY OF THE INVENTION

There is accordingly provided a carrying case comprising a housing having a bottom and a plurality of walls extending from the bottom thereof. A drawer is received by the housing when the carrying case is in a closed configuration. To move the carrying case from the closed configuration to an open configuration, the drawer is removed from the housing and rotated substantially ninety degrees relative to the housing such that the drawer extends substantially perpendicular to the housing when the carrying case is in the open configuration.

There is also provided a carrying case comprising a housing and a drawer received by the housing. The housing has a bottom, a first housing side wall and a second housing side wall both extending from the bottom of the housing, a housing front wall extending from the bottom of the housing between the housing side walls, and a housing rear wall extending from the bottom of the housing between the housing side walls. The drawer has a bottom, a first drawer side wall and a second drawer side wall extending from the bottom of the drawer, a drawer front wall extending from the bottom of the drawer between the drawer side walls, and drawer rear wall extending between the side walls of the drawer. The drawer is received by the housing when the carrying case is in a closed configuration, and the drawer being removed from the housing and rotated substantially ninety degrees relative to the housing when the carrying case is moved from the closed configuration to an open configuration such that the drawer extends substantially perpendicular to the housing when the carrying case is in the open configuration.

The carrying case may further include a housing catch, a drawer catch, and a tension strap. The tension strap may extend between the housing catch and the drawer catch and the tension strap may be extended when the carrying case is in the closed configuration so as to bias the carrying case to the open configuration. Alternatively, the carrying case may further include a first housing catch and a second housing catch disposed on the housing. There may also be a first drawer catch and a second drawer catch disposed on the drawer. A first tension strap may extend between the first housing catch and the second drawer catch. A second tension strap may extend between the second housing catch and the second drawer catch. The first tension strap and second tension strap may be extended when the carrying case is in the closed configuration so as to bias the carrying case to the open configuration.

There may be a recess in an inner side of the first housing side wall and a recess in an inner side of the second housing side wall. The first drawer catch may be disposed within and movable along the recess in the inner side of the first housing side wall. The second drawer catch may be disposed within and movable along the recess in the inner side of the second housing side wall. The first drawer catch may be disposed on the first drawer side wall and the second drawer catch may be disposed on the second side wall of the drawer. The first housing catch and the second housing catch may bother be disposed at the bottom of the housing.

There may be an opening in the bottom of the housing and a protrusion in the drawer. The protrusion may be received by the opening in the bottom of the housing when the carrying case is in the closed configuration. There may be an opening in the rear housing wall. The protrusion may be received by the opening in the rear housing wall when the carrying case is in the open configuration. There may be a groove in the protrusion. The groove in the protrusion may engage an edge of the opening in the rear housing rear wall when the carrying case is in the open configuration.

There may be a groove in the drawer. A free edge of the drawer front wall may be received by the groove when the case is in the open configuration. The drawer front wall may be less than or equal to half the height of the housing rear wall. The drawer may include a cover.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
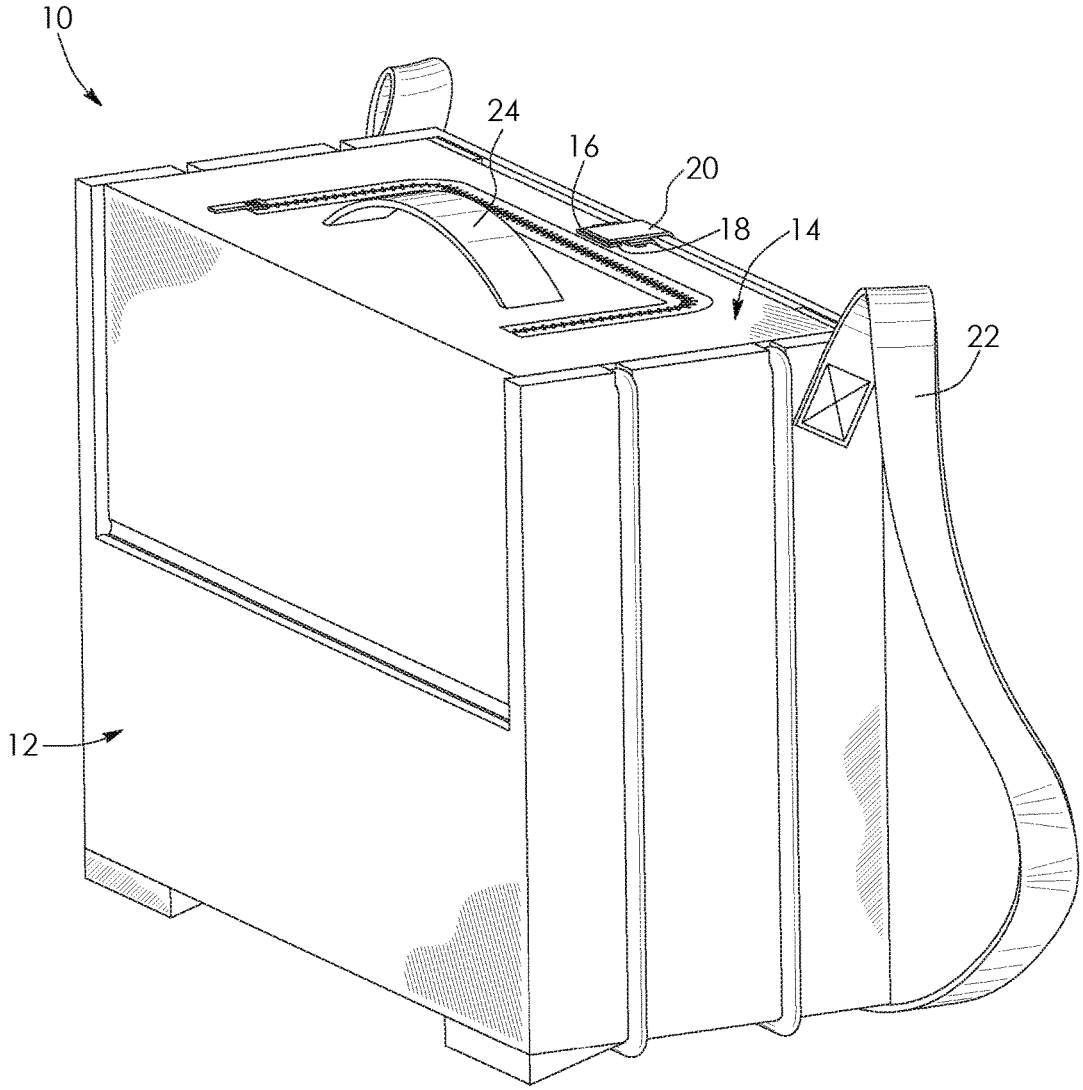
FIG. 1 is a perspective view of a first embodiment of an improved camera carrying case in a closed configuration.

Referring to the drawings and first to FIG. 1, a first embodiment of an improved camera carrying case 10 is shown. The camera carrying case 10 generally includes a housing 12 which receives a drawer 14. There are fasteners in the form of hook and loop fastener strips 16 and 18 similar to the type sold under the trademark VELCRO®. When engaged the fasteners assist in maintaining the camera carrying case 10 in a closed configuration as shown in FIG. 1. A first one of the hook and fastener strips 16 is disposed on the drawer 14 while a second one of the hook and fastener strips 18 is disposed on a closure strap 20 which is connected to the housing 12. There is a strap 22 connected to the housing 12 to facilitate carrying of the camera carrying case 10. There is also a handle 24 on the drawer 14 to facilitate opening of the drawer 14 when the hook and loop fastener strips 16 and 18 are released.

Figure 2:
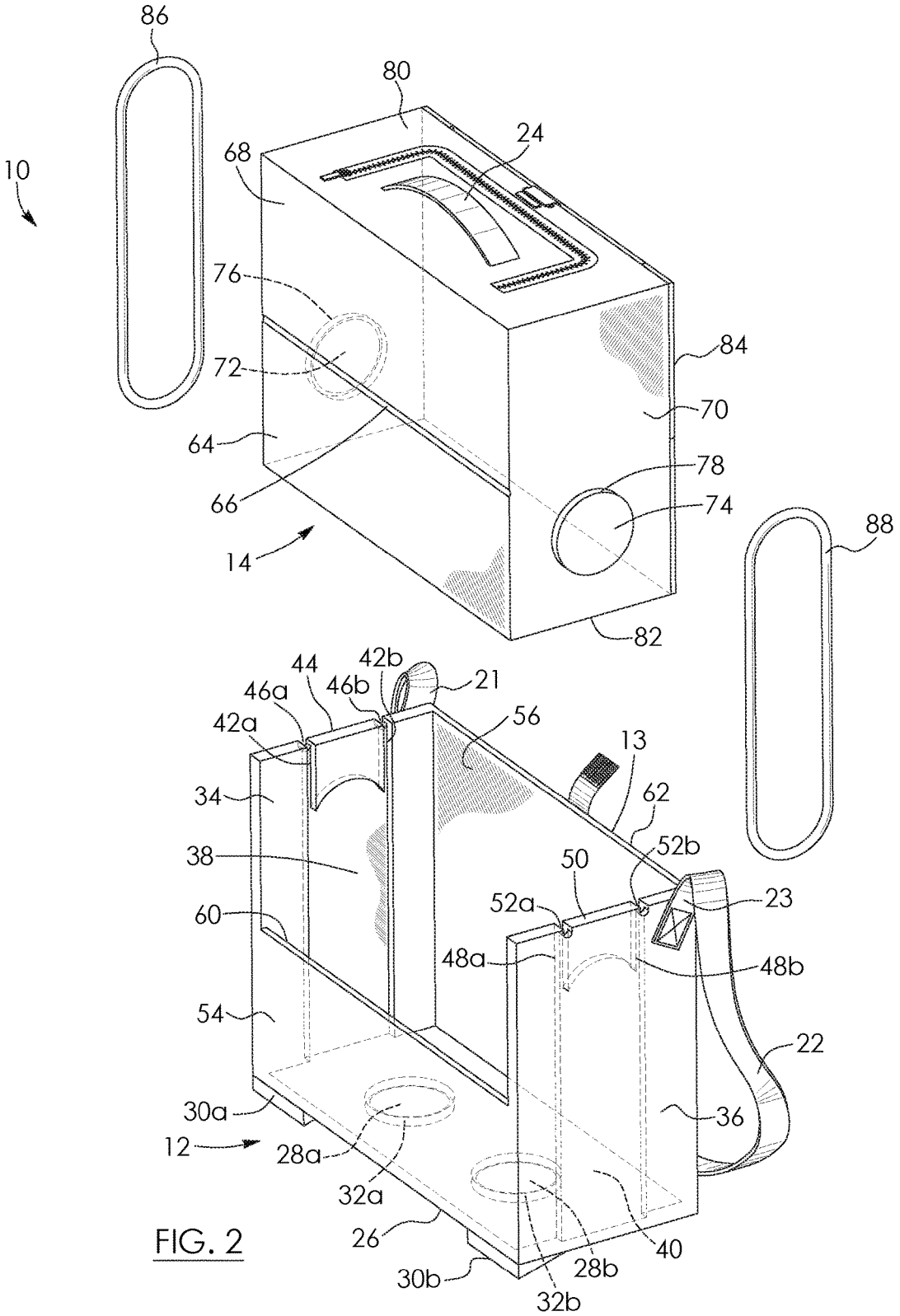
FIG. 2 is an exploded view of the camera carrying case of FIG. 1.

The housing 12 is best shown in FIG. 2. The housing 12 includes a bottom 26 and a pair of housing catches 28*a* and 28*b* extending outwardly from the bottom 26 of the housing 12. There are also a pair of legs 30*a* and 30*b* extending outwardly from the bottom 26 of the housing 12. In this example, the housing catches 28*a* and 28*b* are generally cylindrical with respective circumferential grooves 32*a* and 32*b*. The legs 30*a* and 30*b* are generally wedge shaped and function to balance the camera carrying case 10 when the case is set on a planar surface.

Opposed first and second housing side walls 34 and 36 extend from the bottom 26 of the housing 12. The housing side walls 34 and 36 have respective recesses 38 and 40 on inner sides thereof. The recesses 38 and 40 are arch shaped in this example. There are also grooves 42*a* and 42*b* on the inner side of the first housing side wall 34. The grooves 42*a* and 42*b* extend from the recess 38 in the first housing side wall 34 to a free edge 44 of the first side wall 34. There are notches 46*a* and 46*b* in the free edge 44 of the first housing side wall 32. The notches 46*a* and 46*b* are in communication with a corresponding one of the grooves 42*a* and 42*b* in the first housing side wall 34. Likewise, there are grooves 48*a* and 48*b* on the inner side of the second housing side wall 36. The grooves 48*a* and 48*b* extend from the recess 40 in the second housing side wall 36 to a free edge 50 of the second housing side wall 36. There are notches 52*a* and 52*b* in the free edge 50 of the second housing side wall 36. The notches 52*a* and 52*b* are in communication with a corresponding one of the grooves 48*a* and 48*b* of the second housing side wall 36. Opposite ends 21 and 23 of the strap 22 are respectively connected to outer sides of the housing side walls 34 and 36.

A housing front wall 54 and a housing rear wall 56 also extend from the bottom 26 of the housing 12 and extend between the housing side walls 34 and 36. The housing front wall 54 is lower in height than the housing side walls 34 and 36 and extends only part way to a top 13 of the housing 12. A free edge 60 of the housing front wall 54 extends between the housing side walls 34 and 36. The housing rear wall 56 is substantially equal in height with the housing side walls 34 and 36 and extends to the top 13 of the housing 12. A free edge 62 of the housing rear wall 56 is flush with the free edges 44 and 50 of the housing side walls 34 and 36. In this example, the housing front wall 54 is less than or equal to half the height of the housing rear wall 56 and the housing side walls 34 and 36.

Figure 4:
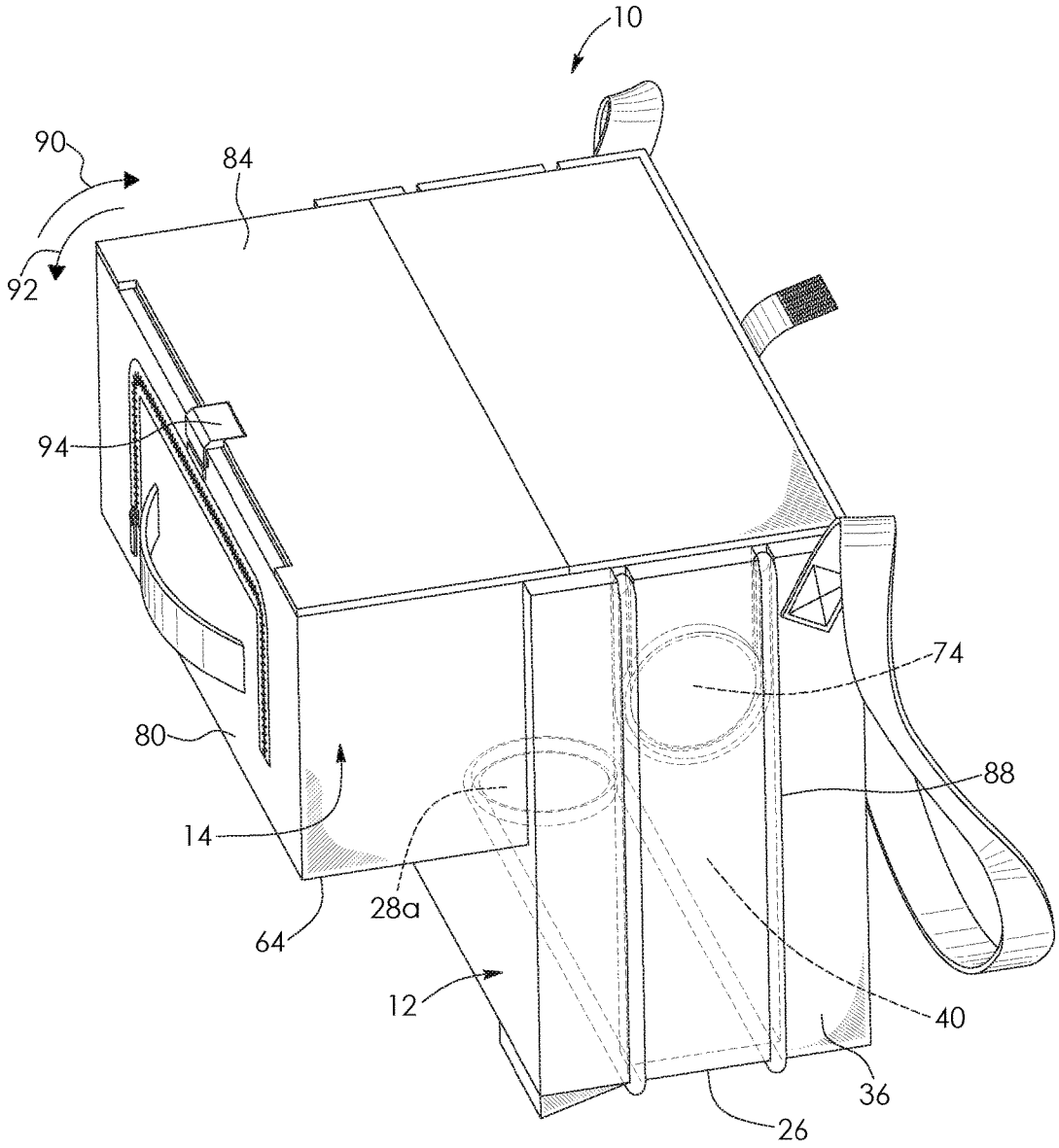
FIG. 4 is a perspective view of the carrying case of FIG. 1 in an intermediate configuration shown partially in ghost.

The drawer 14 is also best shown in FIG. 2. The drawer 14 includes a bottom 64 and a groove 66 extending across the bottom 64 of the drawer 14. The terms "bottom", "front" and "rear" of the drawer 14 as used herein refers to the position when the drawer 14 is open as shown in FIG. 4. In FIG. 2 the drawer 14 is rotated 90 degrees from its open position in FIG. 4. Opposed drawer side walls 68 and 70 extend from the bottom 64 of the drawer. The drawer side walls 68 and 70 have respective drawer catches 72 and 74. In this example, the drawer catches 72 and 74 are generally cylindrical with respective circumferential grooves 76 and 78. The drawer 14 also includes a drawer front wall 80 and a drawer rear wall 82 which both extend between the drawer side walls 68 and 70. The handle 24 is on the drawer front wall 80. The drawer rear wall 82 is received by the housing 12. The drawer also includes a cover 84 which is better shown in FIGS. 4 and 5. Referring back to FIG. 2, the camera carrying case 10 also includes a pair of resilient, endless tension straps 86 and 88 which engage corresponding pairs of the catches on opposite sides of the camera carrying case 10 to couple the drawer 14 to the housing 12 as described below. The tension straps in this example are elastomeric loops similar to thick rubber bands.

Figure 3:
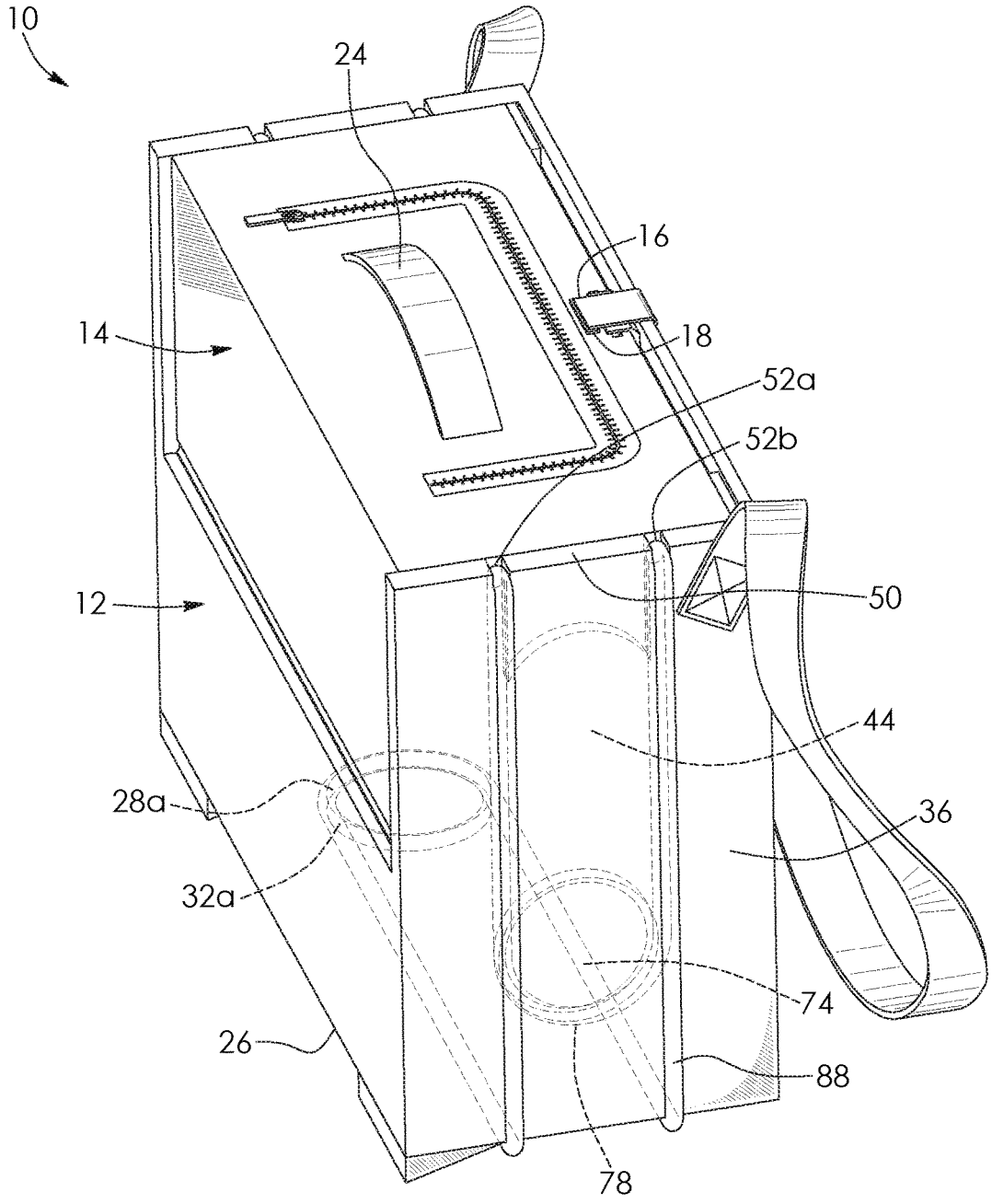
FIG. 3 is a perspective view of the carrying case of FIG. 1 in a closed configuration shown partially in ghost.

Referring now to FIG. 3, one of the tension straps 88 is shown coupling the drawer 14 to the housing 12. It will be understood by a person skilled in the art that the other tension strap 86 couples the drawer 14 to the housing 12 in a similar manner on the opposite side of the drawer 14.

Accordingly, only one of the tension straps 88 is discussed in detail herein with the understanding that the other tension strap 86 functions in a similar manner by engaging similar components on the other side of the drawer. The tension strap 88 engages the circumferential groove 78 of one of the drawer catches 74 and also engages the circumferential groove 32*a* of a first one of the housing catches 28*a*. The tension strap 88 thereby extends about both the drawer catch 74 and the housing catch 28*a*. In particular, the tension strap 88 extends from the housing catch 28*a* on the housing 12, along an outer side of the bottom 26 of the housing 12 and an outer side of the housing side wall 36, to the notches 52*a* and 52*b* in the free edge 50 of the housing side wall 36. The tension strap 88 extends through the notches 52*a* and 52*b* into the grooves 48*a* and 48*b* in the housing side wall 36 which are shown in FIG. 2. Referring back to FIG. 3, the tension strap 88 then extends about the drawer catch 74 on the drawer 14 which is disposed within the recess 40 in the housing side wall 36. The housing catch 74 on the drawer 14 is movable along the recess 40 in the housing side wall 36. In alternative embodiments there may only be a single housing catch, a single drawer catch, and a single tension strap.

When the camera carrying case 10 is in a closed configuration, as shown in FIG. 3, the drawer catch 74 is near the bottom 26 of the housing 12 and the tension strap 88 is extended and stretched. In the closed configuration the drawer 14 is received by the housing 12. Releasing the hook and loop fastener strips 16 and 18 allows a user to use the handle 24 to remove the drawer 14 from the housing 12. The drawer 14 is then be rotated ninety degrees from its position relative to the housing 12 when the camera carrying case 10 is in the closed configuration, shown in FIG. 3, thereby moving the camera carrying case 10 to an intermediate configuration shown in FIG. 4. In the intermediate configuration, the drawer 14 extends perpendicular to the housing 12 and remains covered by the cover 84.

Figures 5, 5A:
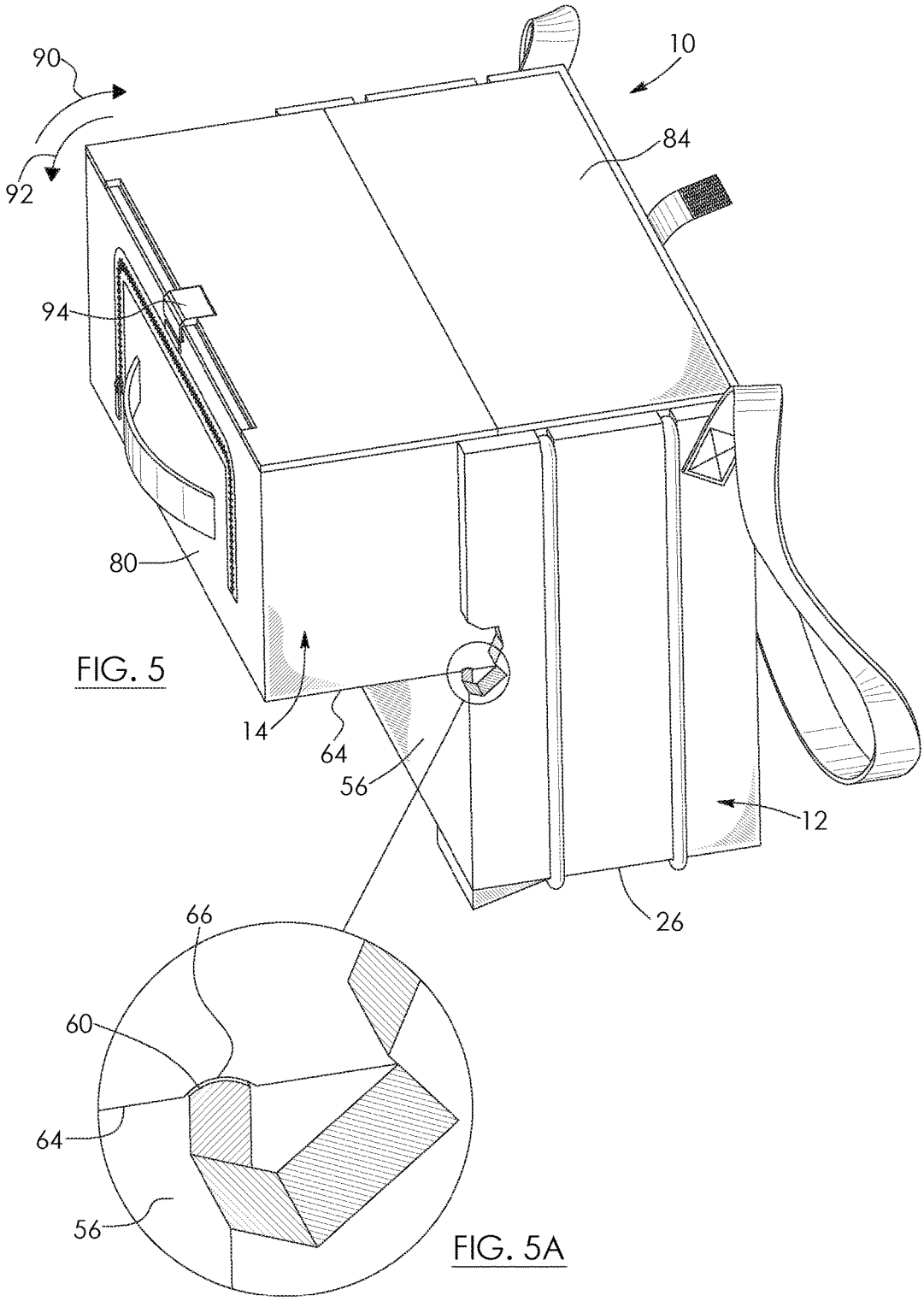
FIG. 5 is a perspective view of the carrying case of FIG. 1 in an intermediate configuration shown partially broken away.
FIG. 5A is an enlarged view of the broken away portion of FIG. 5.

Movement of the camera carrying case 10 from the closed configuration, shown in FIG. 3, to the intermediate configuration, shown in FIG. 4, is facilitated by the potential energy in the extended tension straps 86 and 88 which bias the camera carrying case 10 to the intermediate configuration. The extended tension straps, for example tension strap 88 shown in FIG. 3, facilitate movement of the drawer 14. As the extended tension straps retract, the drawer catches 74 and 76 move away from the bottom 26 of the housing 12. The retracted tension straps, for example tension strap 88 shown in FIG. 4, assist in maintaining the drawer 14 substantially perpendicular to the housing 12 by preventing the drawer 14 from rotating back in the direction indicated generally by arrow 90. This is because a force must be applied to extend the tension straps in order for the drawer catch 74 to be move towards the bottom 26 of the housing to the position shown in FIG. 3. As best shown in FIGS. 5 and 5A, movement of the drawer 14 in the direction indicated generally by arrow 92 is restricted by engagement of the free edge of 60 of the front wall 54 by the groove 66 in the bottom 64 of the drawer 14. In this example, the free edge 60 of the front wall is convex while the groove 66 in the bottom 64 of the drawer 14 is concave.

A fastener in the form of a thumb lock 94, shown in FIG. 5, secures the cover 84 of the drawer 14 to the drawer front wall 80. Actuating the thumb lock 94 allows the camera carrying case 10 to achieve an open configuration, shown in FIG. 6, in which the cover 84 is removed or retracted and a stowed camera 96 may be accessed. In this first embodiment of the camera carrying case 10 there are partitions, for example partition 98, in the drawer 14 which allow a lens 100 or other equipment to be stowed separately from the camera 96. In this first embodiment of the camera carrying case 10 also includes a pocket 102 in the front wall of the drawer 14 which is accessed through a zipper 104.

Figure 7:
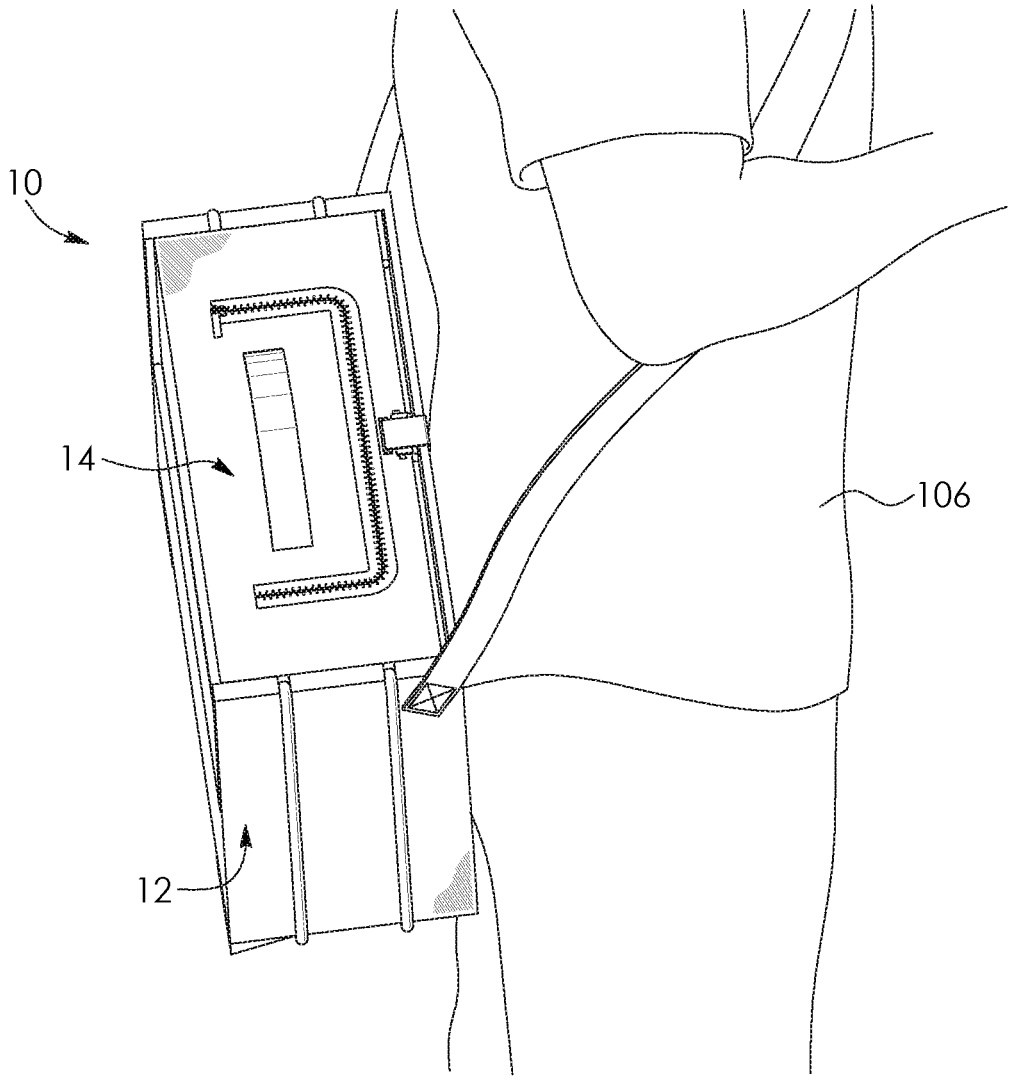
FIG. 7 is a perspective view of the camera carrying case of FIG. 1 in the closed configuration showing the camera carrying case suspended from a shoulder of a person.
Figure 8:
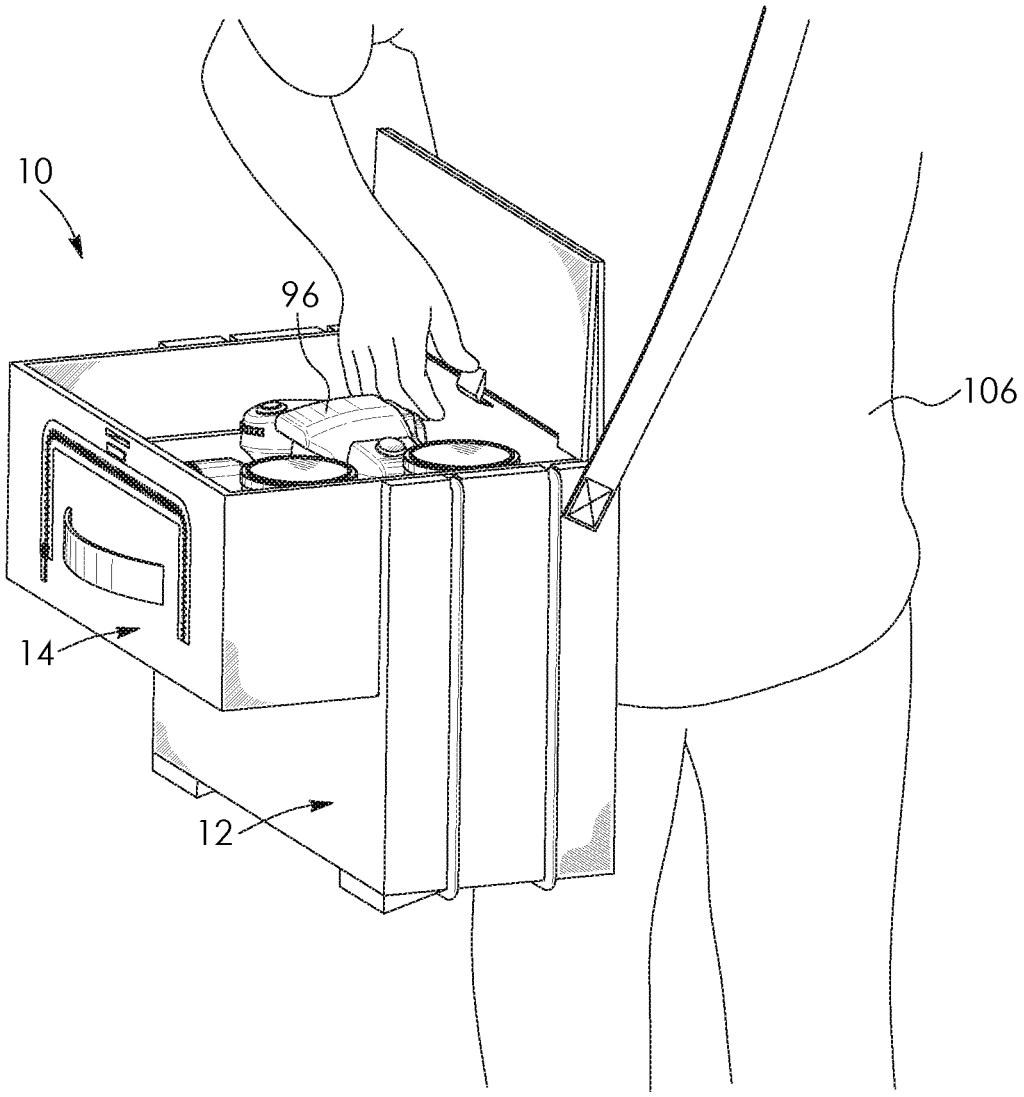
FIG. 8 is a perspective of the camera carrying case of FIG. 1 in the open configuration showing the carrying case suspended from a shoulder of a person.

As shown in FIG. 7, the first embodiment of the camera carrying case 10 disclosed herein allows a user 106 to carry the camera case 10 in either the closed configuration or, as shown in FIG. 8, in the open configuration. In the closed configuration, the drawer 14 is received within the housing 12 and the camera 96 is securely stowed. In the open configuration, the drawer 14 is rotated ninety degrees relative to the housing 12 from its relative position in the closed configuration and the drawer 14 extends substantially perpendicular to the housing 12. The drawer 14 is also uncovered in the open configuration to allow the user 106 access to the camera 96.

Figure 9:
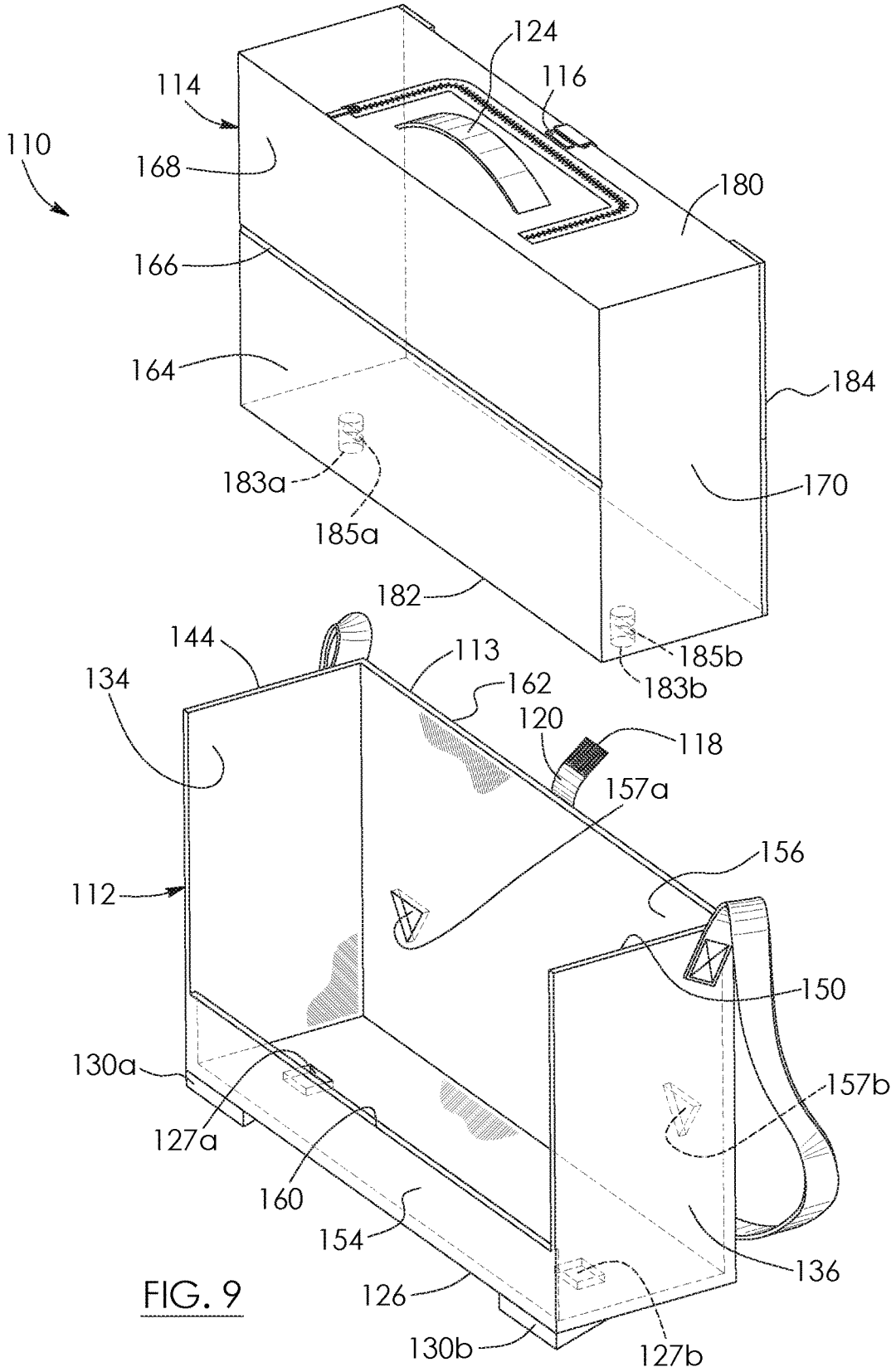
FIG. 9 is an exploded view of a second embodiment of an improved camera carrying case.
Figure 10:
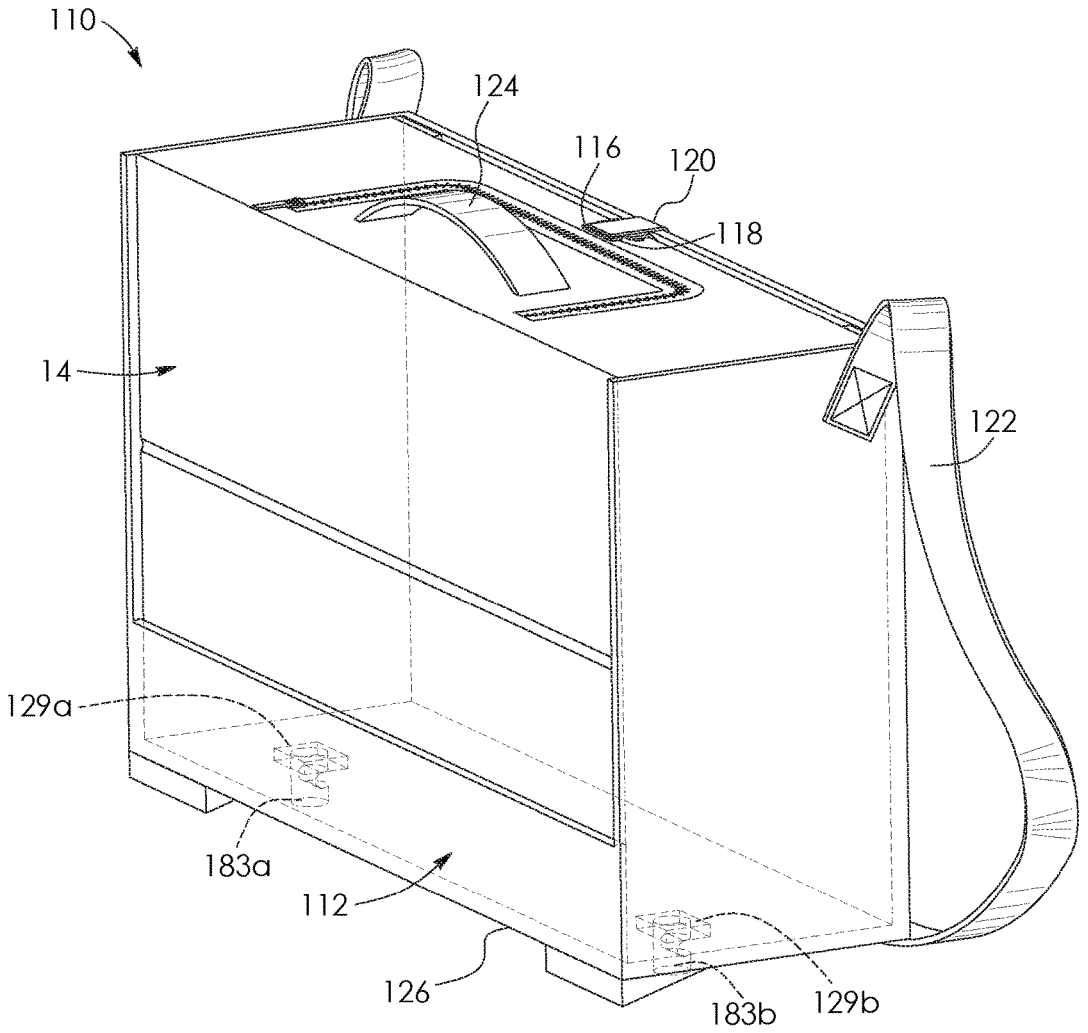
FIG. 10 is a perspective view of the camera carrying case of FIG. 9 in a closed configuration.

Referring now to FIG. 9 a second embodiment of an improved camera carrying case 110 is shown. The camera carrying case 110 generally includes a housing 112 which receives a drawer 114. There are fasteners in the form of hook and loop fastener strips 116 and 118 similar to the type sold under the trademark VELCRO®. When engaged the fasteners assist in maintaining the camera case in a closed configuration as shown in FIG. 10. A first one of the hook and fastener strips 116 is disposed on the drawer 112 while a second one of the hook and fastener strips 118 is disposed on a closure strap 120 which is connected to the housing 112. There is a strap 122 connected to the housing 112 to facilitate carrying of the camera carrying case 110. There is also a handle 124 on the drawer 114 to facilitate removal of the drawer 114 from the housing 112 when the hook and loop fastener strips 116 and 118 are released.

Referring back to FIG. 9, the housing 112 includes a bottom 126 with a pair of openings 127*a* and 127*b*. There is also a pair of legs 130*a* and 130*b* extending outwardly from the bottom 126 of the housing 112. In this example, the legs 130*a* and 130*b* are generally wedge shaped and function to balance the camera carrying case 110 when the case is set on a planar surface. Opposed first and second housing side walls 134 and 136 extend from the bottom 126 of the housing 112 to a top 113 of the housing. A housing front wall 154 and a housing rear wall 156 also extend from the bottom 126 on the housing 112 and between the housing side walls 132 and 136. There is a pair of spaced-apart openings 157*a* and 157*b* in the housing rear wall 156.

The housing front wall 154 is lower in height than the housing side walls 134 and 136. A free edge 160 of the housing front wall 154 extends between the housing side walls 134 and 136 but is below respective free edges 144 and 150 of the housing side walls 134 and 136. The rear wall 156 is substantially equal in height to the housing side walls 134 and 136. A free edge 162 of the housing rear wall 156 is flush with the free edges 144 and 150 of the housing side walls 134 and 136. In this example, the housing front wall 154 is less than or equal to one third the height of the housing rear wall 156.

The drawer 114, includes a bottom 164 and a groove 166 extending across the bottom 164 of the drawer 114. The terms "bottom", "front" and "rear" of the drawer 114 as used herein refers to the position when the drawer 114 is open as shown in FIG. 10. In FIG. 9 the drawer 114 is rotated 90 degrees from its open position in FIG. 10. Opposed first and second drawer side walls 168 and 170 extend from the bottom 164 of the drawer. The drawer 114 also includes a drawer front wall 180 and a drawer rear wall 182 which both extend between the drawer side walls 168 and 170. The handle 124 is on the drawer front wall 180 while the drawer rear wall 182 is received within the housing 112. There are a pair of spaced-apart protrusions 183*a* and 183*b* extending outwardly from the drawer rear wall 182. The protrusions 183*a* and 183*b* have respective grooves 185*a* and 185*b*. The drawer 114 also includes a cover 184 which is better shown in FIG. 11.

In the closed configuration, shown in FIG. 10, the protrusions 183*a* and 183*b* on the drawer 114 are received within the openings 129*a* and 129*b* in the bottom 126 of the housing 112. This restricts movement of the drawer 114 relative to the housing 112 unless the drawer 114 is first pulled out of the housing so the protrusions 183*a* and 183*b* on the drawer 114 are released from the openings are 129*a* and 120*b* in the bottom 126 of the housing 112.

Figure 6:
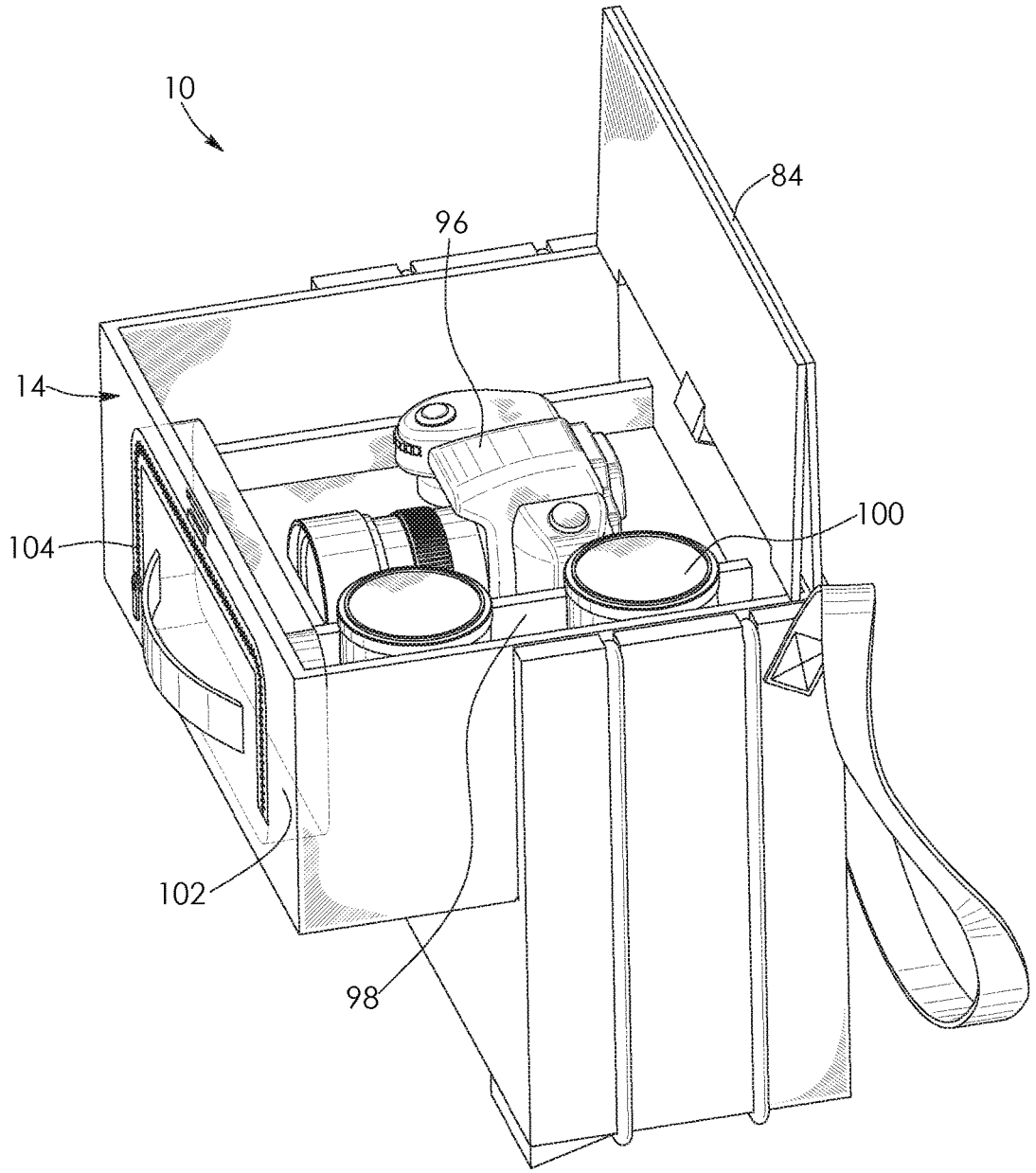
FIG. 6 is a perspective view of the camera carrying case of FIG. 1 in an open configuration and containing a camera and a lens.
Figure 11:
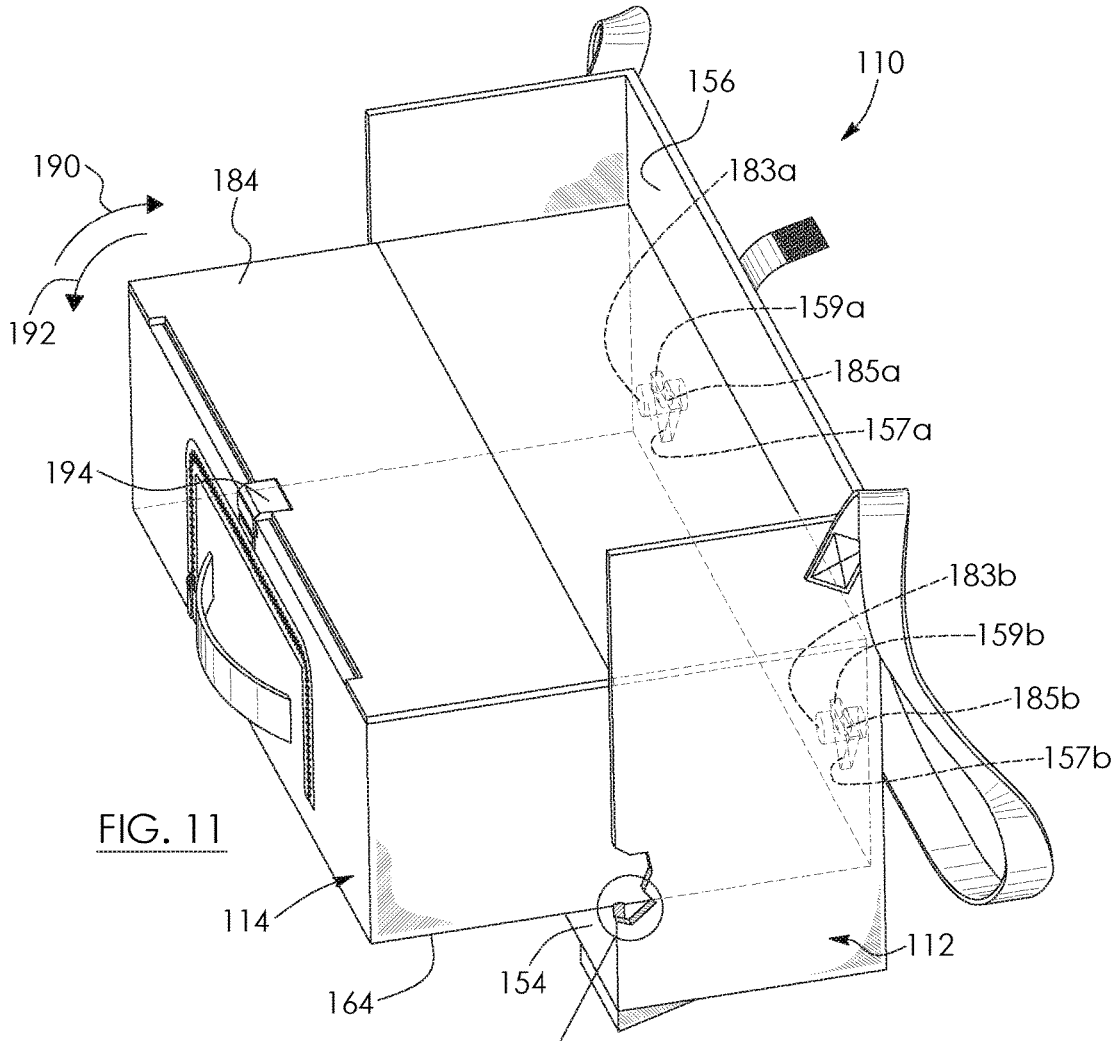
FIG. 11 is a perspective view of the carrying case of FIG. 9 in an intermediate configuration shown partially broken away and partially in ghost.
Figure 11A:
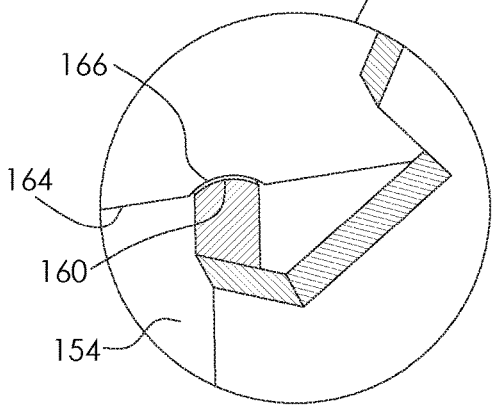
FIG. 11A is an enlarged view of the broken away portion of FIG. 11.

Movement of the camera carrying case 110 from the closed configuration, shown in FIG. 10, to the intermediate configuration, shown in FIG. 11, requires that the drawer 114 be pulled out of the housing 112 and that the drawer 114 be rotated ninety degrees from its position relative to the housing 112 when the camera carrying case 110 is in the closed configuration, shown in FIG. 10. The drawer 114 is uncovered by actuating a thumb lock 194 to move the second embodiment of the camera carrying case 110 to the open configuration similar to as shown in FIG. 6 for the first embodiment of the camera carrying case 10. In the intermediate configuration the drawer 114 extends substantially perpendicular to the housing 112.

Referring back to FIG. 11, when the second embodiment of the camera carrying case 110 is in the intermediate or open configuration, the protrusions 183*a* and 183*b* on the drawer 114 are received within respective one of the openings 157*a* and 157*b* in the housing rear wall 156. Rotation of the drawer 114 in the direction indicated generally by arrow 192 is restricted by the groove 185*a* and 185*b* in the protrusions 183*a* and 183*b* on the drawer 114 which engage respective edges 159*a* and 159*a* of the openings 157*a* and 157*b* in the rear wall 156 of the housing 112. Rotation of the drawer 114 in the direction indicated generally by arrow 192 is also restricted by engagement of the free edge of 162 of the front wall 154 with the groove 166 in the bottom 164 of the drawer 114. The second embodiment of the camera carrying case 110 disclosed herein is generally used with larger cameras and rotation of the drawer 114 in the direction indicated generally by arrow 190 is restricted by the weight of the camera.

It will be understood by a person skilled in the art that many of the details provided above are by way of example only, and are not intended to limit the scope of the invention which is to be determined with reference to the following claims.

What is claimed is:

1. A carrying case comprising:

a housing having a bottom, a first housing side wall and a second housing side wall extending from the bottom of the housing, a housing front wall extending from the bottom of the housing between the housing side walls and the housing front wall having a free edge, and a housing rear wall extending from the bottom of the housing between the housing side walls; and a drawer received by the housing, the drawer having a bottom, a first drawer side wall and a second drawer side wall extending from the bottom of the drawer, a drawer front wall extending from the bottom of the drawer between the drawer side walls, and drawer rear wall extending between the side walls of the drawer, the drawer being received by the housing when the carrying case is in a closed configuration, and the drawer being removed from the housing and rotated substantially ninety degrees relative to the housing when the carrying case is moved from the closed configuration to an open configuration such that the drawer extends substantially perpendicular to the housing, and the bottom of the drawer sits along substantially an entire length of the free edge of the front wall of the housing, when the carrying case is in the open configuration.

2. The carrying case as claimed in claim 1 further including:

a first housing catch and a second housing catch disposed on the housing;

a first drawer catch and a second drawer catch disposed on the drawer; and a first tension strap extending between the first housing catch and the second drawer catch, and a second tension strap extending between the second housing catch and the first drawer catch, wherein the first tension strap and second tension strap are extended when the carrying case is in the closed configuration so as to bias the carrying case to the open configuration.

3. The carrying case as claimed in claim 2 further including a recess in an inner side of the first housing side wall and a recess in an inner side of the second housing side wall, wherein the first drawer catch is disposed within and movable along the recess in the inner side of the first housing side wall, and the second drawer catch is disposed within and movable along the recess in the inner side of the second housing side wall.

4. The carrying case as claimed in claim 2 wherein:

the first drawer catch is disposed on the first drawer side wall and the second drawer catch is disposed on the second side wall of the drawer; and the first housing catch and the second housing catch are both disposed at the bottom of the housing.

5. The carrying case as claimed in claim 1 further including:

an opening in the bottom of the housing; and a protrusion in the drawer, wherein the protrusion is received by the opening in the bottom of the housing when the carrying case is in the closed configuration.

6. The carrying case as claimed in claim 1 further including:

an opening in the rear housing wall; and a protrusion in the drawer, wherein the protrusion is received by the opening in the housing rear wall when the carrying case is in the open configuration.

7. The carrying case as claimed in claim 6 further including a groove in the protrusion, wherein the groove in the protrusion engages an edge of the opening in the housing rear wall when the carrying case is in the open configuration.

8. The carrying case as claimed in claim 1 further including a groove in the bottom of the drawer, wherein the free edge of the drawer front wall is received by the groove when the case is in the open configuration.

9. The carrying case as claimed in claim 1 wherein the drawer front wall is less than or equal to half the height of the housing rear wall.

10. The carrying case as claimed in claim 1 wherein the drawer further includes a cover.

* * * * *